US009988822B2

(12) United States Patent
Quesada Barbero

(10) Patent No.: US 9,988,822 B2
(45) Date of Patent: Jun. 5, 2018

(54) DEVICE FOR LEVELLING COATING PARTS

(71) Applicant: GERMANS BOADA, S.A., Barcelona (ES)

(72) Inventor: Juan Antonio Quesada Barbero, Barcelona (ES)

(73) Assignee: GERMANS BOADA, S.A., Barcelona (ES)

( * ) Notice: Subject to any disclaimer, the term of this patent is extended or adjusted under 35 U.S.C. 154(b) by 0 days. days.

(21) Appl. No.: 15/550,805

(22) PCT Filed: Feb. 17, 2016

(86) PCT No.: PCT/ES2016/070095

§ 371 (c)(1),
(2) Date: Aug. 14, 2017

(87) PCT Pub. No.: WO2016/132007

PCT Pub. Date: Aug. 25, 2016

(65) Prior Publication Data

US 2018/0023307 A1 Jan. 25, 2018

(30) Foreign Application Priority Data

Feb. 19, 2015 (ES) ..... 201530203

(51) Int. Cl.
*E04F 21/20* (2006.01)

(52) U.S. Cl.
CPC ..... *E04F 21/20* (2013.01)

(58) Field of Classification Search
CPC .... B23Q 1/25; B23Q 1/36; B23Q 3/06; B25B 7/00; B25B 7/20; B25B 9/00
See application file for complete search history.

(56) References Cited

U.S. PATENT DOCUMENTS 6,473,955 B1 11/2002 Huang
6,928,743 B1 * 8/2005 Marshall ..... E04F 21/1855 33/648
2006/0185269 A1 8/2006 Kufner et al.
2008/0040988 A1 * 2/2008 Holt ..... E04F 21/185 52/127.2

(Continued)

FOREIGN PATENT DOCUMENTS

BR 102012004934 10/2013
ES 1106110 4/2014

(Continued)

*Primary Examiner* — Lee D Wilson
(74) *Attorney, Agent, or Firm* — Hodgson Russ LLP

(57) ABSTRACT

The invention relates to a device comprising a first part (1) provided with a base (11) and a rod (12) having an opening or recess (13) for the engagement of an actuation tool (3), a second part (2) provided with a through-opening (21) for mounting on the rod (12) of the first part (1) and a surface for supporting the tool (3), as well as a tool (3) of the second part (2) along the rod (12) of the first part (1). The tool (3) comprises: a first arm (31) and a second arm (32) hinged on an intermediate shaft (33), having respective ends (31*a*, 32*a*) for acting on the first part (1) and the second part (2), and respective handles (31*b* and 32*b*); a mechanism (4) for positioning and regulating the rotational relative movement of the arms (31, 32).

2 Claims, 3 Drawing Sheets

(56) References Cited

U.S. PATENT DOCUMENTS

| | | | | |
|---|---|---|---|---|
| 2013/0255182 | A1 | 10/2013 | Kufner et al. | |
| 2017/0050231 | A1* | 2/2017 | Marcon | B25B 7/02 |
| 2018/0023307 | A1* | 1/2018 | Quesada Barbero | E04F 21/20 |

FOREIGN PATENT DOCUMENTS

| | | |
|---|---|---|
| GB | 2060467 | 12/1983 |
| GB | 2195732 | 1/1990 |
| WO | 2011012994 | 5/2011 |
| WO | 2014022889 | 2/2014 |

* cited by examiner

DEVICE FOR LEVELLING COATING PARTS

OBJECT OF THE INVENTION

The object of the present invention is a device for levelling coating parts, and more specifically, the coplanar arrangement of said coating parts during the installation thereof; the aforementioned device comprises a first part provided with a base and a rod having at least one hole or recess for the engagement of an actuation tool; a second part provided with a through-opening suitable for mounting on the rod of the first part and can be moved towards the base thereof and with a surface for supporting the actuation tool; and a manual actuation tool for moving the second part along the rod of the first part towards an operative position in which the first part and second part exert a pressure on two opposite faces of at least two adjacent coating parts.

This invention primarily focuses on an actuation tool that notably facilitates and simplifies the actuation of the levelling device.

FIELD OF APPLICATION OF THE INVENTION

This invention is applicable to the manufacture of devices for placing ceramic parts.

STATE OF THE ART

In the utility model application U 201430412, a levelling device for placing coating parts, object of the same applicant of the present invention, is described and it comprises a first part with a base provided on the top with a rod, a second part provided with a through-opening suitable for mounting on the rod of the first part and can be moved towards the base thereof and an actuation tool for moving the second part along the rod of the first part.

The tool in question comprises a grip handle, at least one front tooth intended to be introduced into one of the holes or recesses of the rod of the first part and at least one cam with a variable pitch to be supported on a surface of the second part and to provide it with a push towards the base of the first part by means of the actuation of the tool.

Although this tool fulfills the actuation function for which it was designed, the owner of the invention developed an actuation tool of the levelling device that has characteristics intended to improve the actuation thereof by the operator and the transmission of stress to the first part and second part of the levelling device.

DESCRIPTION OF THE INVENTION

The device for levelling coating parts, object of this invention, being included in the precharacterizing part of the first claim and comprising a first part provided with a base and a rod having at least one hole or recess; and a second part provided with a through-opening for mounting on the rod of the first part and can be moved towards the base of said first part; has the particular feature of comprising an actuation tool that significantly improves that described in the cited prior art.

Specifically, this actuation tool comprises: a first arm and a second arm hinged on an intermediate shaft, having respective ends for acting on the first part and the second part, and respective grip handles; said actuation tool further comprising a positioning mechanism of the arms in positions with different degrees of opening, and for regulating the rotational relative movement of said arms in each of the said positions.

The two tool arms are arranged on opposite sides of the intermediate shaft such that when the handles are clasped to cause them to move closer together, the actuation ends, responsible for actuating the first part and the second part of the device, are separated.

In one embodiment of the invention, the first arm has a hook on the actuating end that can be coupled to a hole or recess of the rod of the first part of the device, while the second end of the arm has a fork on the arm for acting intended to be supported on an upper surface of the second part, said fork allowing the rod of the first part of the device to pass through the inside thereof.

The positioning mechanism of the tool arms with different degrees of opening comprises: a separator mounted transversely with respect to said arms and provided with a longitudinal slotted hole in which a pin of the first arm of the tool is mounted, and can be rotated and moved along the slotted hole.

Said separator has on a first side an alignment of recesses that define, in an operative coupling position with a secured tooth of the second arm, relative positions of the tool arms with different degrees of opening.

With these characteristics, the aforementioned positioning mechanism allows, by introducing the secure tooth of the second arm into one of the recesses of the aforementioned separator, the two tool arms to be in different relative positions with regard to the degree of opening thereof, temporarily maintaining the separator in a secured position with respect to the second arm of the tool.

In any of the positions determined by coupling the secured tooth of the second arm in the different recesses of the separator, the first arm can define rotational relative movement with respect to the second arm, the range of said rotational movement being determined by the movement of the pin of the first arm along the slotted hole of the aforementioned separator.

These characteristics allow the ends of the tool arms to first be arranged with greater or lesser separation, depending on the thickness of the coating parts to be levelled, and the user can easily actuate the tool and ensure the correct positioning and levelling of the coating parts with limited actuation and in any case where the length is equal to or less than that of the slotted hole of the positioning separator of the tool arms.

According to the invention, the positioning mechanism further comprises a spring that acts with the opposite ends against the first arm and the separator, said spring tending to keep the separator in a coupling position of any one of the recesses with the secured tooth of the second arm and keeping the tool in an inoperative position, determined by the contact of the pin with the end of the slotted hole farthest from the other arm of the tool.

DESCRIPTION OF THE FIGURES

As a complement to the description provided herein, and for the purpose of helping to make the characteristics of the invention more readily understandable, the present specification is accompanied by a set of drawings, which, by way of illustration and not limitation, represent the following.

PREFERRED EMBODIMENT OF THE INVENTION

Figure 1:
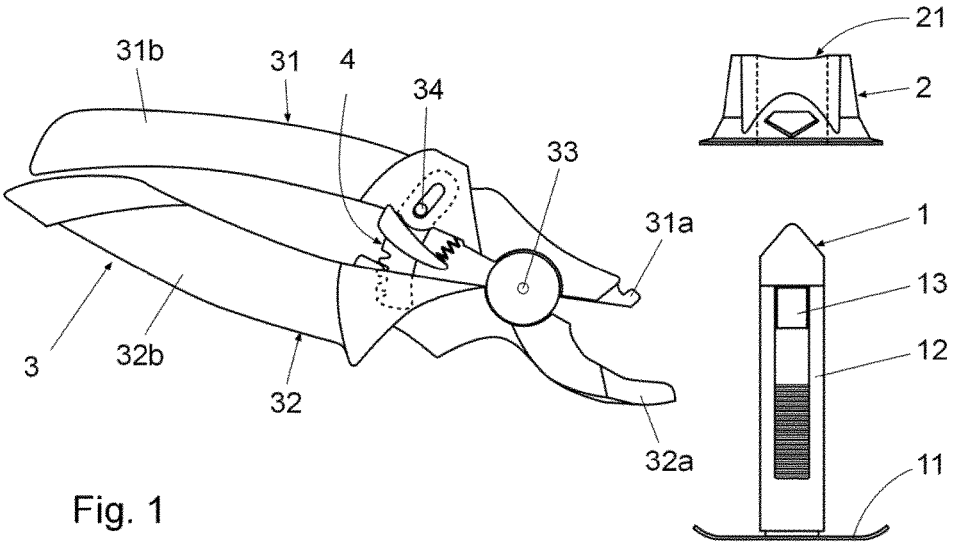
FIG. 1 shows an elevation view of the device for levelling coating parts according to the invention.

In FIG. 1, a first part (1) of the device provided with a base (11) and a rod (12) having a hole (13); and a second part (2) provided with a through-opening (21) for mounting on the rod (12) of the first part and which can be moved towards the base (11); the rod (12) and the through-opening (21) having complementary means of retention (not shown) that prevent the backward movement and release of the second part (2) with respect to the rod (12) of the first part, can be observed.

In said FIG. 1, the actuation tool (3) comprising a first arm (31) and a second arm (32) articulated on an intermediate shaft (33) can also be observed.

The first arm (31) has an end (31*a*) like a hook, suitable for being introduced in the window (13) of the separator (12) of the first part (1) and for pushing the same and a handle (31 *b*). In turn, the second arm (32) of the tool (3) comprises an end (32*a*) like a fork, intended to be supported on an upper surface of the second part (2) and a handle (32*b*).

Figure 2:
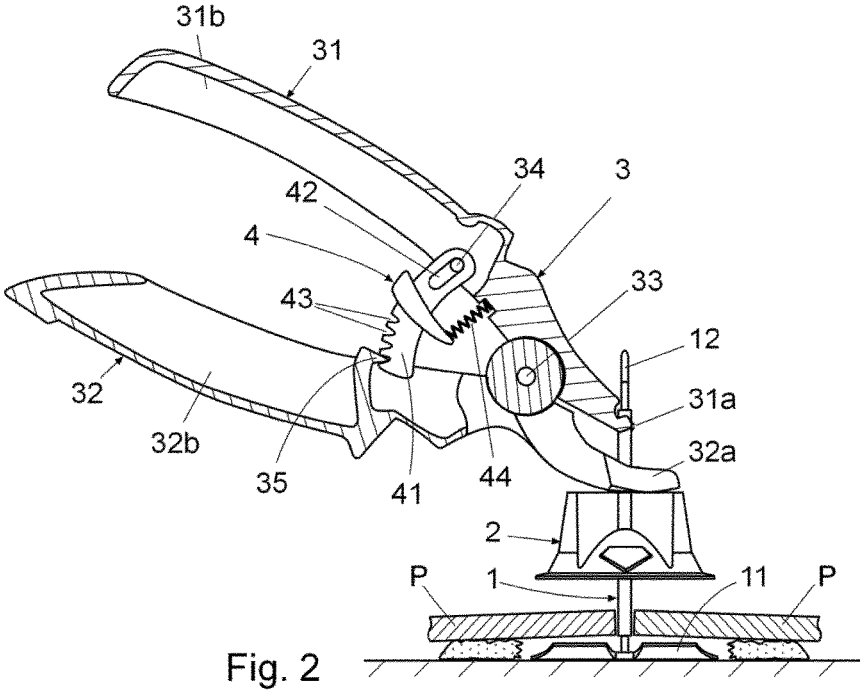
FIG. 2 shows a view of the device of the previous figure with a vertical cross section of the actuation tool and the ends thereof attached to the first part and the second part of the device before levelling the two coating parts.
Figure 3:
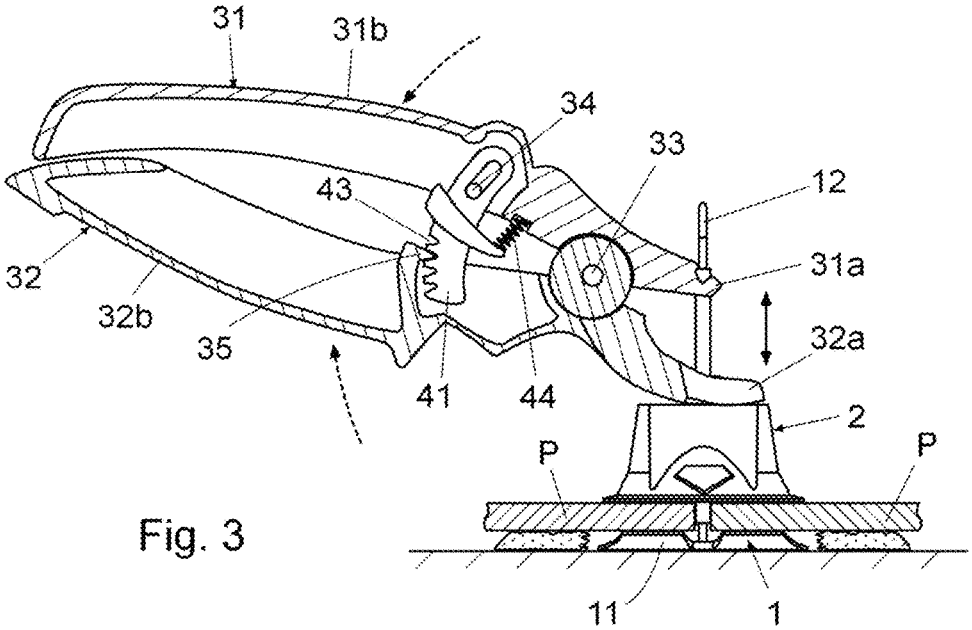
FIG. 3 shows a view similar to the previous figure once the actuation tool is operated, the device levelling the two coating parts.
Figure 4:
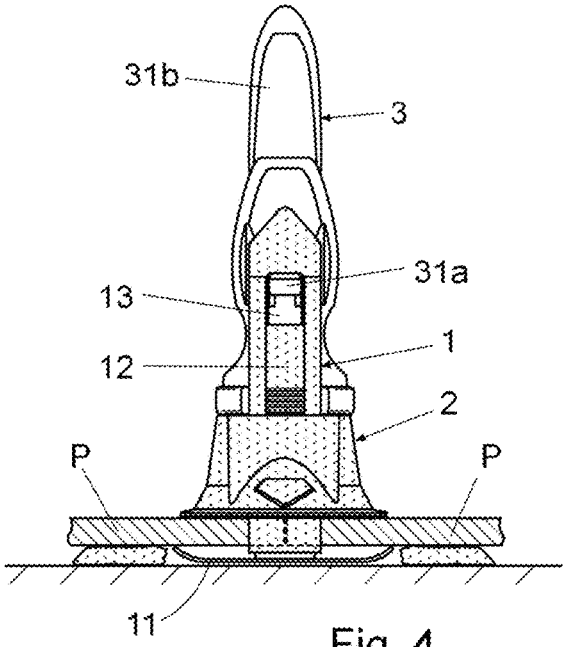
FIG. 4 shows a front elevation view of the device for levelling in the same position as the previous figure.

As shown in FIGS. 2 and 3, once the rod (12) of the first part (1) is arranged between two coating parts (P) to be secured to a surface, and the ends (31*a*, 32*a*) of the actuation tool being correctly positioned with respect to the first part (1) and the second part (2), one only needs to clasp the handles as shown in FIG. 3 to ensure that the second part (2) moves along the rod (12) of the first part, trapping the coating parts (P) between the base (11) of the first part and the second part (2), such that said coating parts (P) are levelled.

The tool comprises a mechanism (4) for positioning of the arms (31, 32) of the tool (3) in various positions, in different degrees of opening, and for regulating the rotational relative movement of said arms once arranged in any of the positions allowed by the positioning mechanism (4).

This mechanism (4) comprises a separator provided with a longitudinal slotted hole (42) through which a pin (34) of the first arm (31) is mounted, said separator (41) has on a first side an alignment of recesses (34) for optionally housing a secured tooth (35) defined in the second arm (32) of the tool (3), such that the arms (31, 32) can have different degrees of opening by introducing the secured tooth (35) into one of the recesses (43).

Choosing one position or another will depend on the thickness of the coating parts (P) to be installed.

Once one of the said positions is chosen, the first arm (31) of the tool can rotate with respect to the second arm (32) in a space determined by the path of the pin (34) along the slotted hole (42), said path being enough to actuate the first part (1) and the second part (2) of the device.

The mechanism (4) for positioning the arms comprises a spring (44) that acts with the opposite ends on the first arm (31) and the separator (41), said spring (44) tending to maintain the tool (3) in an inoperative position shown in FIG. 2, and determined by the contact of the pin (34) with said end of the slotted hole (42) farthest from the other arm (32). Additionally, said spring (44) tends to maintain the separator (41) in an operative position, shown in FIGS. 1, 2 and 3, in which any one of the recesses (43) of the separator (41) remains coupled to the secured tooth (35) of the second arm (32).

Figure 5:
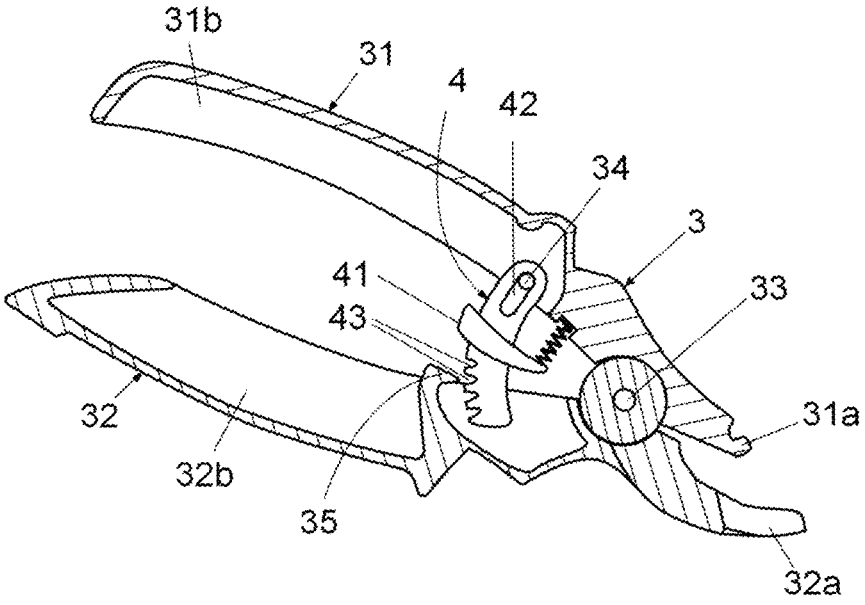
FIG. 5 shows a view of a vertical cross section of the actuation tool during the position change of the positioning mechanism of the arms.

The aforementioned spring (44) also enables the separator (41) to be manually moved, overcoming the force of the spring (44), as shown in FIG. 5, in order to free it from the secured tooth (35) and so that the arms (31, 32) of the tool can be opened to a greater or lesser extent, one of the recesses (43) subsequently coupling to the separator (41) with the secured tooth (35) based on the desired degree of opening.

Having sufficiently described the nature of the invention, in addition to an example of a preferred embodiment, it is hereby stated for the relevant purposes that the materials, shape, size and layout of the described elements may be modified, provided that it does not imply altering the essential characteristics of the invention claimed below.

The invention claimed is:

1. A device for levelling coating parts; applicable in the coplanar arrangement of said coating parts during the installation thereof; comprising: a first part (1) of the device provided with a base (11) and a rod (12) having at least one hole or recess (13) for the engagement of an actuation tool (3); a second part (2) provided with a through-opening (21) suitable for mounting on the rod (12) of the first part (1) and can be moved towards the base (11) thereof and with a surface for supporting the actuation tool (3); and an actuation tool (3) for moving the second part (2) along the rod (12) of the first part (1) towards an operative position in which the first part (1) and second part (2) exert a pressure on two opposite faces of at least two adjacent coating parts (P); characterized in that the actuation tool (3) comprises: a first arm (31) and a second arm (32) articulated on an intermediate shaft (33), having respective ends (31*a*, 32*a*) for acting on the first part (1) and the second part (2), and respective handles (31 b and 32*b*); a mechanism (4) for positioning of the arms (31, 32) of the tool in positions with different degrees of opening and for regulating the rotational relative movement of said arms (31, 32) in each of the said positions.

2. The device according to claim 1, characterized in that the positioning mechanism (4) comprises: a separator (41) provided with a longitudinal slotted hole (42) in which a pin (34) of the first arm (31) of the tool is mounted and can be rotated and moved along the same; said separator (41) having on a first side an alignment of recesses (43) that define, in a coupling position with a secured tooth (35) of the second arm (32), relative positions of the arms (31, 32) of the tool (3) with different degrees of opening and; a spring (44) that acts with the opposite ends on the first arm (31) and the separator (41), said spring (44) tending to maintain the separator (41) in a coupling position in any one of the recesses (43) with the secured tooth (35) of the second arm (32) and to maintain the tool (3) in an inoperative position, determined by the contact of the pin (34) with said end of the slotted hole (42) farthest from the other arm (32) of the tool.

* * * * *